United States Patent [19]

Katsube

[11] 4,027,886

[45] June 7, 1977

[54] GOLF SWING TIMING DEVICE

[76] Inventor: Toyonari Katsube, 2-4-3, Takeyama, Midori, Yokohama, Japan

[22] Filed: Sept. 19, 1975

[21] Appl. No.: 614,977

[52] U.S. Cl. ..... 273/186 A; 273/1 M

[51] Int. Cl.[2] ..... A63B 69/36

[58] Field of Search ..... 273/186 A, 194 R, 194 A, 273/194 B, 186 R

[56] References Cited

UNITED STATES PATENTS

| | | | |
|---|---|---|---|
| 2,135,648 | 11/1938 | Stumpf | 273/186 A |
| 3,113,782 | 12/1963 | Guier | 273/186 A |
| 3,136,553 | 6/1964 | Davis | 273/186 A |
| 3,360,268 | 12/1967 | Molinari | 273/186 A |
| 3,433,478 | 3/1969 | Span et al. | 273/1 M |

*Primary Examiner*—George J. Marlo
*Attorney, Agent, or Firm*—Robert I. Pearlman

[57] ABSTRACT

This invention relates to a device for measuring the rhythm and impact timing in golf club swings by noting the golfer's swing position corresponding to the collision of a movable tube with a stopper tube both located on the golf club shaft. Said movable tube is initially held against a magnetic element positioned at the upper grip portion of the tube, said magnetic element capable of being varied in its magnetic attractive, force. The movable tube is moved from said magnetic element due to centrifugal force during the golfer's swing.

3 Claims, 7 Drawing Figures

FIG. 1
FIG. 3
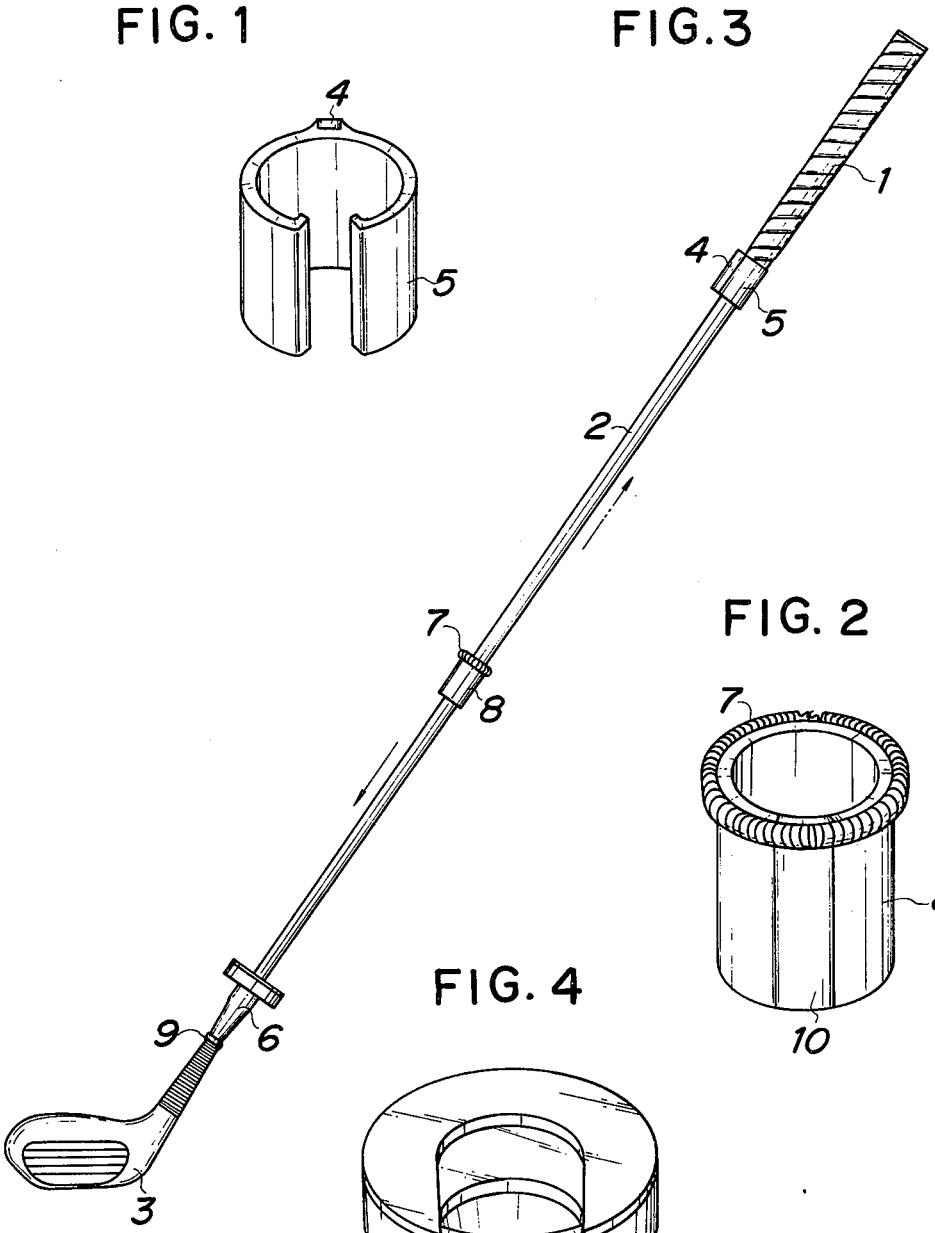
FIG. 2
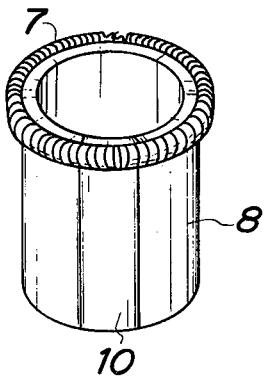
FIG. 4
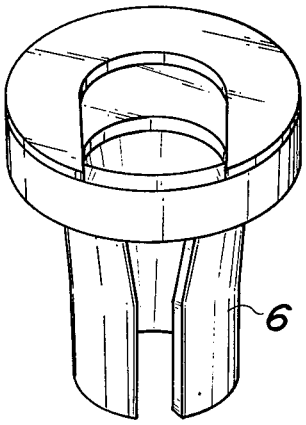

GOLF SWING TIMING DEVICE

BACKGROUND OF THE INVENTION

Rhythm and timing are the most important factors for a good golf club swing. In order to realize a desirable swinging rhythm and timing, a golfer must master both mental and technical control of the swing. The pattern of such rhythm and timing, however, varies from one person to the other depending on age, physical build, faculty, kidney and other matters, and can never be judged with a certainty. Many theoretical faults on swings in actual play are noted and most of such faults have a direct relation to rhythm and timing. For instance, it is noted that a short and quick swing which is often committed by unskilled golfers can result in "hitting from the top" (which is a fatal defect for golf swinging). As a remedy for this, it has been suggested to delay the impact timing. It is also said that the excessive difference between "whiffing" and actual ball-hitting swings result from the loss of technical control of the swing due to "mental yoke" on the golfer. As a solution to this problem swinging the club always with constant timing is advised.

Although most golfers can well understand these hints as "knowhow", they find it extremely difficult to translate them into action, and therefore appropriate training methods and correcting tools or implements suited therefor are acutely sought. Heretofore various types of effective implements attached to the club shaft or head for practice of swings have been proposed. However, no simple implement designed exclusively for measuring the rhythm and timing of swing is available.

SUMMARY OF THE INVENTION

Eyeing such fact, the present invention provides a novel device which allows the golfer to learn the process of his individual swing with distinct physical evidence and to easily find out by himself the faults, means of correction and correcting effect, and which is also so designed to be usable for "whiffing" but also when actually hitting a ball. More particularly, the point in the golfer's swing corresponding to when a collision is reached by a movable tube moving down the golf shaft and a stop tube is utilized to improve his golf swing.

DRAWINGS

The present invention is now described in detail by way of an embodiment thereof while referring to the accompanying drawings, in which:

FIG. 1 is a perspective view of a magnet tube;

FIG. 2 is a perspective view of a movable tube;

FIG. 3 is a general side view of the present device as it was adapted to a golf club;

FIG. 4 is an enlarged perspective view of a stopper tube;

Figure 5:
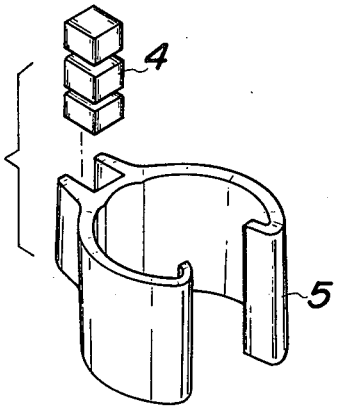
FIG. 5 is a perspective view showing the manner of setting in position or removing a desired number of magnets in the magnet tube.

Now describing the present invention, the embodiment shown in FIG. 3 comprises a magnet tube 5 carrying a magnet or magnets 4 therein and fixed on a part of the club shaft 2 adjacent to the grip 1. A stopper tube 6 is similarly fixed on the shaft 2 close to the clubhead 3, and a movable tube 8 carrying a spring coil 7 is fitted on the shaft 2 so as to be movable in both directions along said shaft.

The magnet tube 5, as shown in FIGS. 1 and 5, is so constructed that the magnets are placed snugly in an opening formed on the upper side of the tube. The tube is tightly secured to the club shaft by way of an opening or cutout in the lower side of the tube. The movable tube 8, as best shown in FIG. 2, is fitted on the shaft by removing a side piece 10, and after it was fitted on the shaft, said side piece is again placed in position and then a spring coil 7 is fixed in the groove at the tube end in opposition to the magnet in the magnet tube so that when said movable tube comes close to the magnet tube, said coil is attracted by and stuck to the magnet tube.

The stopper tube 6 is also fitted on and fixed to the club shaft through a vertical opening such that its side with greater outer diameter is opposed to the movable tube as shown in FIG. 3. This stopper tube 6 is so constructed so as to produce a clearly discernible moderate reverberation when the movable tube hits against it. Both said magnet tube 5 and stopper tube 6 are made of a hard plastic material so that they are fixed to their respective given positions. An adhesive resin tape 9 or the like is wound on the head side portion of the stopper tube 6 to prevent movement of said tube toward the head.

Figure 7:
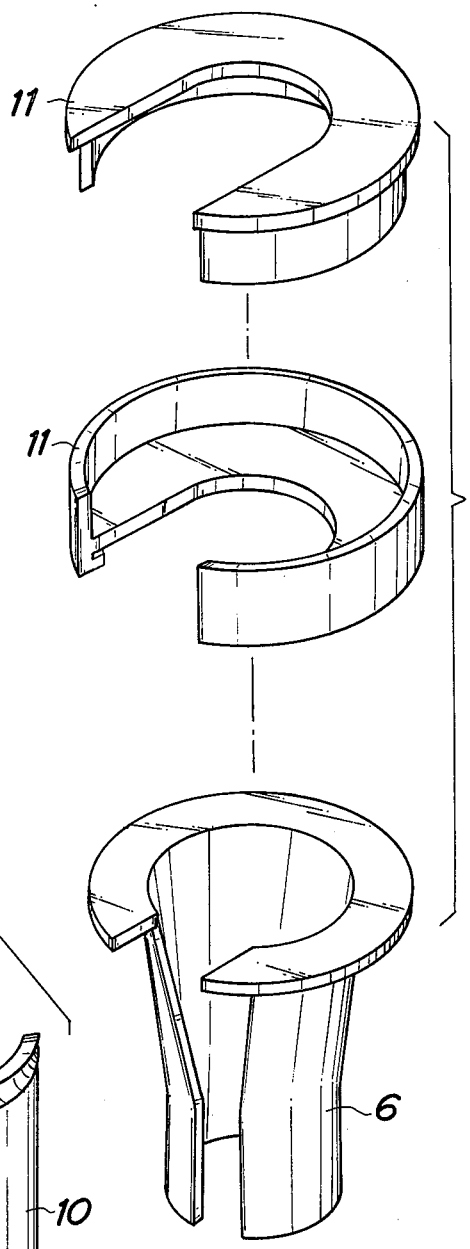
FIG. 7 is a perspective view showing the construction of a sound generator and a stopper tube.
Figure 6:
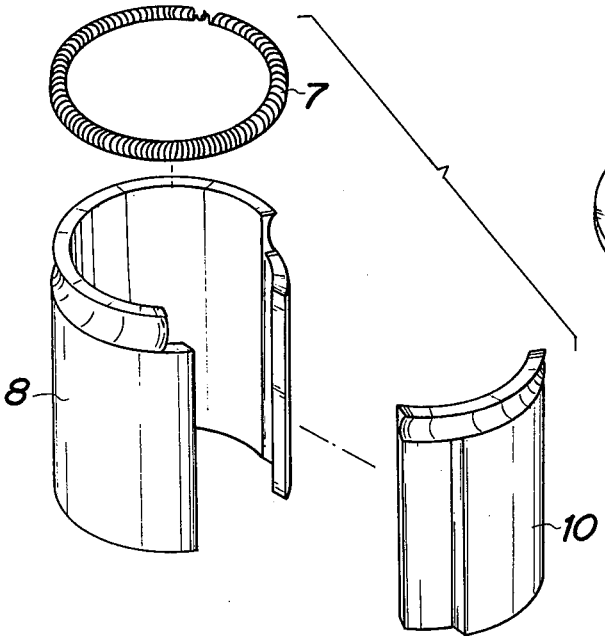
FIG. 6 is an exploded view of the movable tube for showing the construction thereof.

Adjustment of the force of attraction of the magnet tube 5 with relation to the movable tube 8 is accomplished either by using a magnet having just the requisite magnetic force to hold tube 8 in contact therewith, or by increasing or decreasing the number of magnets set in the magnet tube 5 as shown in FIG. 5. The magnets in the magnet tube 5 may be arranged suitably, such as for example circularly, in conformity to the abutting face of the movable tube 8. Instead of a spring the movable tube may be provided with a metal piece secured to its face which is to be contacted with the magnet tube. The stopper tube 6 may be of such a construction that a sound generator 11 is mounted thereon by fitting two separate members, such as shown in FIG. 7, on the tube by utilizing their openings and turning them to the position. Said members may be ones which are beforehand fixed in position on the stopper tube.

As described above, the device of the present invention is characterized by the fact that a constant attraction force is retained between the magnet tube 5 and movable tube 8 which are fitted on the shaft 2, as additionally is the stopper tube 6, whereby the rhythm and timing of the swing can be learned from the position of collision between the movable tube 8 and stopper tube 6 that takes place on the path of the clubhead due to the centrifugal force produced by the swing.

The present invention is described more particularly by way of the following embodiment thereof.

The user is requested first of all to make a suitable adjustment of the magnetic force by raising the shaft uprightly to let the movable tube magnetically attach to the magnet tube, and to then perform a swing in the following way:

a. Backswing is started slowly from the address.

b. During the first half of the downswing, the club is smoothly moved down while keeping the wrist cocked as it is.

c. In the last half of the downswing, the wrist is uncocked quickly to swing vigorously through the impact zone.

During the steps (a) and (b) in the abovesaid stroke of swing, the movable tube is kept attached to the magnet tube by magnetic attraction. In step (c) the ideal position of collision between the movable tube and stopper tube is learned from the sound produced by the collision of said movable tube and stopper tube.

Measurement of timing can be achieved with the following effects.

d. If the backswing is too fast, the movable tube separates from the magnet tube and hits against the stopper tube before entering the topswing. Therefore, the user can teach himself to correct the pace of the constant backswing.

e. If the downswing is started too hastily or if the wrist is uncocked too quickly, collision of the movable tube against the stopper tube takes place far before the clubhead enters the impact zone, that is, immediately after start of the downswing. Therefore, the swinger can learn or correct with ease the rhythm of the downswing, clubhead accelerating method and timing for uncocking of the wrist.

f. The position of collision of the movable tube against the stopper tube in the last half of the downswing, that is, in the impact zone is an important factor for effective use of the shaft to maximize the head speed. So, by determining the ideal position of collision from the device, the swinger can learn good timing for swinging.

g. It is also an important feature of the present invention that it allows the swinger to compare the actual impact position and the position of collision of the movable tube by actually hitting a ball, and to know the difference in rhythm between "whiffing" and actual hitting.

Thus, by using the device of the present invention, the swinger can easily break himself of a bad habit of "hitting from the top" by repeatedly practicing and correcting his swings while confirming the ideal impact position. He can also improve his swing power by continuously measuring and grasping the best swinging pace and rhythm and the most effective impact timing for him. Further, he can release himself from the aforesaid "mental yoke" by learning the way of maintaining the rhythm and timing realized in "whiffings" during repeated actual ball hitting practice.

Various modifications can be made to the present invention without departing from the spirit thereof. For example, the stop and magnetic elements can be other than tubular in form.

What is claimed is:

1. A device for measuring time of a golf swing comprising:
   1. a golf club having a shaft, a clubhead portion and a grip portion;
   2. a magnet element fixedly positioned on a part of the golf club shaft adjacent to the grip portion, said magnet element being in the form of a tube having replaceable magnetic inserts to vary its magnetic attractive force;
   3. a stop unit fixedly mounted on said golf club shaft at a position close to the clubhead, and
   4. a movable tube having a metal portion which can be attracted by the magnet element, said movable tube being also fitted on said club shaft intermediate said magnet element and said stop unit and being adapted to move away from said magnet element toward said stop unit in response to centrifugal force created by the golfer's swing so as to collide with said stop unit.

2. The device of claim 1 wherein said tube and said stop unit are composed of hard plastic material.

3. A device for measuring time of a golf swing comprising:
   1. a golf club having a shaft, a clubhead portion and a grip portion;
   2. a magnet element fixedly positioned on a part of the golf club shaft adjacent to the grip portion, said magnet element adapted to be varied in its magnetic attractive force;
   3. a stop unit fixedly mounted on said golf club shaft at a position close to the clubhead, and
   4. a movable tube fitted on said club shaft intermediate said magnet element and said stop unit and having an upper metallic spring element so as to hold said tube about said golf club shaft as well as being attracted to said magnet element, said movable tube being adapted to move away from said magnet element toward said stop unit in response to centrifugal force created by the golfer's swing so as to collide with said stop unit.

* * * * *